United States Patent [19]

Edwards

[11] 4,207,826

[45] Jun. 17, 1980

[54] THROAT PLATE WITH THREAD SEPARATOR RIB

[75] Inventor: William J. Edwards, Cranbury, N.J.

[73] Assignee: The Singer Company, Stamford, Conn.

[21] Appl. No.: 950,655

[22] Filed: Oct. 12, 1978

[51] Int. Cl.[2] ..... D05B 57/14

[52] U.S. Cl. ..... 112/184; 112/228

[58] Field of Search ..... 112/181, 183, 184, 185, 112/187, 197, 201, 202, 228, 230, 231, 302, 308

[56] References Cited

U.S. PATENT DOCUMENTS

| | | | |
|---|---|---|---|
| 565,816 | 8/1896 | Towns | 112/308 |
| 1,775,913 | 9/1930 | Parkes | 112/184 |
| 2,989,017 | 6/1961 | Taketomi | 112/181 X |
| 3,194,197 | 7/1965 | Ketherer | 112/184 X |
| 4,095,539 | 6/1978 | Johnson | 112/185 |

FOREIGN PATENT DOCUMENTS

| | | |
|---|---|---|
| 1633818 | 11/1951 | Fed. Rep. of Germany . |
| 47-21857 | 11/1972 | Japan . |

*Primary Examiner*—Werner H. Schroeder
*Assistant Examiner*—Andrew M. Falik
*Attorney, Agent, or Firm*—Edward L. Bell; Robert E. Smith; Michael H. Wallach

[57] ABSTRACT

A throat plate having a anti-haloing member attached thereto to separate the work limb of a loop of needle thread from the take-up limb during the setting of a stitch thereby preventing the work limb from being drawn up through the material being sewn by frictional interengagement with the take-up limb.

4 Claims, 3 Drawing Figures

THROAT PLATE WITH THREAD SEPARATOR RIB

BACKGROUND OF THE INVENTION

1. Field of the Invention

This invention relates to a sewing machine throat plate construction for deterring a condition referred to as "haloing" in which loose needle thread loops remain above the fabric being stitched.

2. Description of the Prior Art

In the formation of lock stitches by a sewing machine, an eye pointed needle carries a thread through the work fabric where the thread is seized by a loop taker, formed into a needle thread loop, concatenated with a bobbin thread, and then drawn up or set into the fabric to form a stitch. The loop of needle thread seized by the loop taker is comprised of two limbs; the work limb extending from the loop taker to the previous stitch; and the take-up limb extending from the loop taker to the thread supply. If the work limb is frictionally interengaged by the take-up limb in its upward excursion, the work limb may be drawn above the surface of the fabric and form a loose stitch or halo.

Prior known anti-haloing devices carried on the throat plate have provided slots or passageways for frictionally restraining the work limb to prevent interengagement of the two thread limbs.

One problem with prior known anti-haloing throat plates is that they constrain the needle thread loop in disadvantageous positions which must be compensated for by other components of the sewing machine thread handling system.

Another problem is that they may not be optimally suited for use with a wide range of thread types and thicknesses.

Still another problem is that they unnecessarily complicate the construction of a throat plate.

SUMMARY OF THE INVENTION

It is an object of this invention to provide for a lock stitch sewing machine having a vertical axis hook located in front of the needle a throat plate having an anti-haloing member fastened thereto which separates the needle thread work limb from the take-up limb.

Another object of this invention is to provide an anti-haloing throat plate which is devoid of a thread slot or passageway of vertical dimension and can therefore be easily and economically constructed.

It is also an object of this invention to provide an anti-haloing throat plate which, because it does not constrain the needle thread loop in an abnormal position, may be retrofitted to a sewing machine without the need to modify any additional components of the sewing machine.

The disclosed objects and other advantages are achieved by a throat plate which has a fin shaped member depending downwardly from its bottom surface toward the loop taker. The fin is located before the needle aperture in the direction of material feed and is arranged to depend substantially perpendicular to the bottom surface of the throat plate. The fin member has a ramp surface which extends from the bottom surface of the throat plate toward the needle aperture, and terminates in a vertical wall near the needle aperture.

The loop of thread cast off from the loop taker is drawn across the fin shaped member while the stitch is being set as the needle rises. The work limb segment of the loop is separated from the take-up limb by the interposition of the fin member between the thread limbs which precludes frictional interengagement therebetween. The ramp surface of the fin member allows the loop to be easily drawn thereacross as the remaining thread of the loop is drawn against the bobbin thread in the last stages of stitch setting, the fin member thereafter being unobtrusive to thread motion when limb interengagement is desirable.

BRIEF DESCRIPTION OF THE DRAWINGS

The above and other objects of this invention will become evident from a full and complete understanding of the preferred embodiment which is hereinafter set forth in such detail as to enable those skilled in the relevant art to readily understand the function, operation, construction, and advantages of it when read in conjunction with the accompanying drawings in which.

DESCRIPTION OF THE PREFERRED EMBODIMENT

Figure 1:
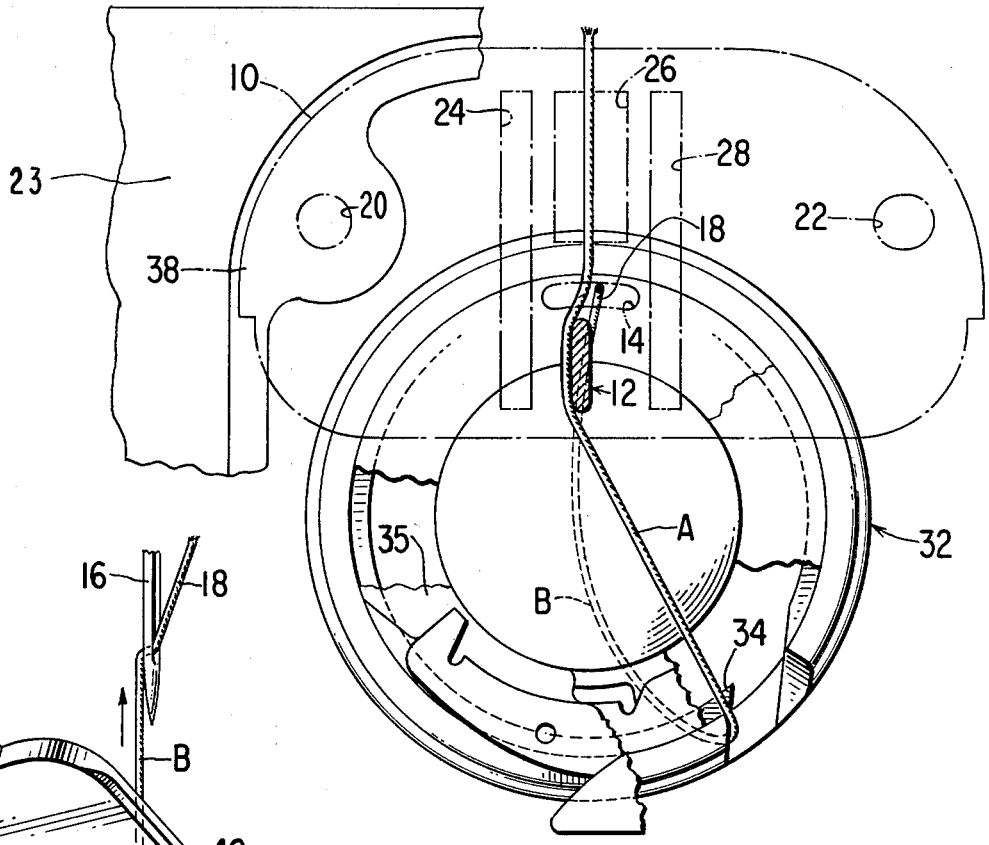
FIG. 1 is a top view of a throat plate having an anti-halo fin member constructed in accordance with this invention applied thereto, showing how the member engages the work limb and take-up limb of a loop of thread being expanded by a loop taker.
Figure 2:
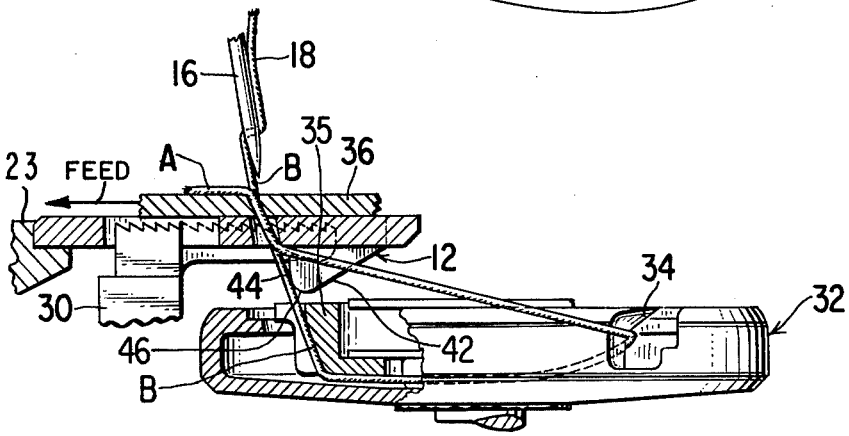
FIG. 2 is a side view of the parts with the loop taker in substantially the same position as shown in FIG. 1 and showing how the fin member cooperates with the loop of thread as the loop is expanded by the loop taker.

Referring to the drawings, FIG. 1 shows a throat plate 10 which has an anti-haloing fin member 12 constructed in accordance with the teachings of this invention attached thereto. The throat plate 10 is of a conventional design, having an arcuate shaped needle aperture 14 through which a needle 16 (FIG. 3) reciprocates to carry a needle thread 18 which is concatenated with a bobbin thread (not shown) in the formation of a lock-stitch in a well known manner. The throat plate 10 has a round hole 20 at one extremity and an elongated hole 22 at the opposite extremity for securing the throat plate 10 to the bed 23 of a sewing machine. The throat plate 10 also contains three laterally elongated parallel feed apertures 24, 26 and 28 for the purpose of accommodating a sewing machine feed dog 30 one part of which is shown in FIG. 2. The needle 16 reciprocates in timed relation to the rotation of a loop taker 32 which has a beak 34 for seizing a loop of needle thread shed from the needle 16 during the upward excursion of the needle 16 through a fabric 36 being sewn. Preferably the loop taker 32 is of a vertical axis type, that is it is rotatably fastened to a vertical shaft, a fragment of which is shown in FIG. 2, having a vertical axis which is in front of the needle aperture 14 in the direction of material feed. Preferably the rotation of the loop taker 32 causes the loop seizing beak 34 to traverse a horizontal path which is parallel to and below the plane of a bottom surface 38 of the throat plate.

Figure 3:
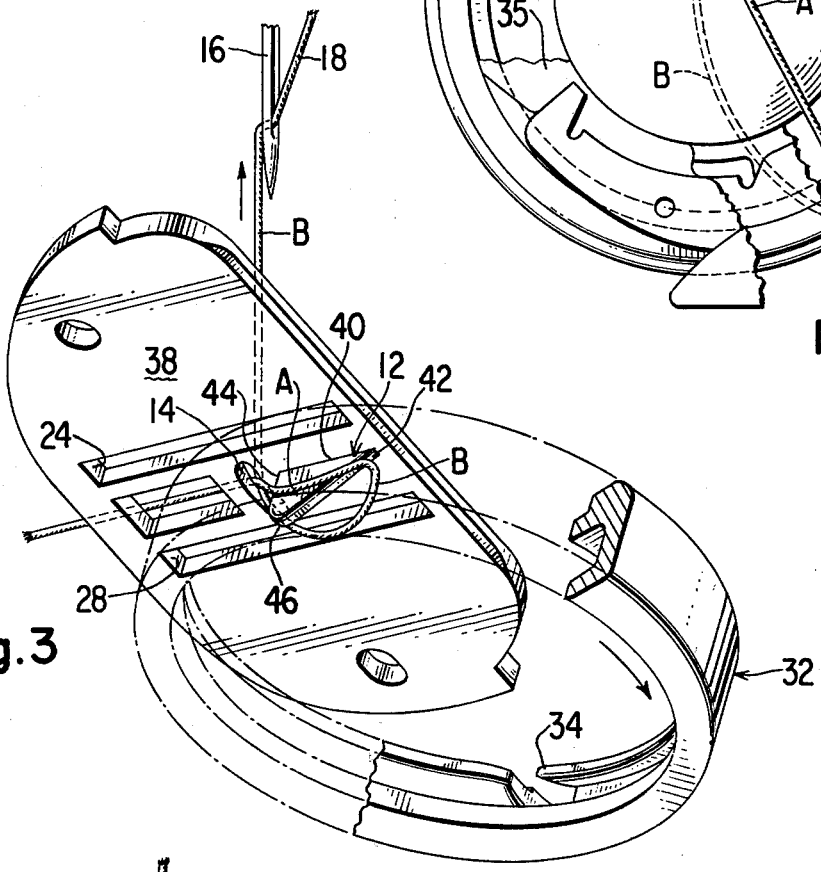
FIG. 3 is an underside perspective view showing how the fin member separates the work limb from the take-up limb as the take-up limb is being drawn upward.

FIG. 3 best illustrates that the bottom surface 38 of the throat plate 10 has the thread limb separating fin-shaped member 12 depending therefrom. Preferably the fin member 12 is disposed in front of the needle aperture 14 in the direction of material feed as shown by the arrow in FIG. 2, and between the elongated feed apertures, 24 and 28. The fin member 12 is fastened within a slot 40 contained in the throat plate 10 by any convenient means, as for example, with cement. FIG. 3 shows that the fin member 12 contains a ramp or back surface 42 which permits a loop of thread to be conveniently drawn across the fin member 12. Preferably the ramp surface 42 is connected to a vertical surface 44 by an arcuate segment 46, which insures that a loop of thread will freely be shed from the fin member 12 as it is drawn across the ramp surfaces 42 during the stitch formation process. The fin member 12 is provided with smooth substantially unbroken surfaces which are free of any thread detaining irregularities.

The operation of the anti-haloing throat plate may best be observed by reference to FIG. 2 which shows a loop of needle thread after it has been seized by the beak 34 of the loop taker 32. The loop of thread has a take-up limb B which is drawn upward through a material being sewn and a work limb A which is restrained in the material being sewn. It will be appreciated by one skilled in the art of sewing that as the loop taker rotates, the loop of needle thread is concantenated with a bobbin thread (not shown) by passing the loop of thread around a bobbin case, a portion of which is shown at 35 in FIG. 2, to form a lockstitch in a well known manner. The bobbin case 35 is accommodated within the loop taker 32, with the beak 34 of the loop taker 32 moving in a horizontal path about the bobbin case 35. FIG. 2 also shows that the rotation of the loop taker 32 directs the work limb A over the bobbin case 35 and the take-up limb B beneath the bobbin case 35, thereby constraining the work limb and take-up limb in different paths as the loop taker expands the loop of needle thread. It may be seen from FIG. 1 that while the loop of thread is seized by the loop taker 32 the work limb A remains on one side of the fin member 14. After the loop of thread is cast off from the loop taker 32, the thread handling instrumentalities of the sewing machine act on the take-up limb B to draw it through the material being sewn during the stitch formation process. As the take-up limb B is drawn up, the loop of thread is drawn away from the beak 34 of the loop taker 32 and, since the work limb A is restrained in the material 36 and on one side of the fin member 12, the take-up limb B will be drawn up against the side of the fin member 12 opposite that on which the work limb A lies.

It may be seen from FIG. 3 that as the take-up limb B continues to be drawn upwardly, the loop of thread about the fin member 12 will become smaller, until a portion of the loop will begin to slide across the back surface 42 of the fin member. During the time that the fin member 12 is interposed between the work limb A and the take-up limb B, frictional interengagement between the two limbs will be obviated, thereby minimizing the opportunity for the formation of halos. As the take-up limb B is drawn upwardly toward its ultimate position against the material being sewn, the loop of thread will slide up and off the back surface 42 and will be drawn through the needle aperture 14. The work limb A and the take-up limb B will therefore only have an opportunity to frictionally interengage during the period of time that they are drawn through the needle aperture 14.

It will be appreciated that modifications and variations of the described invention may become evident to one skilled in the art in light of the above teachings. However, it is to be understood that the present disclosure relates to but one preferred embodiment which is for the purpose of illustration only, and not to be construed as a limitation of the invention. All such modifications which do not depart from the spirit of the invention are intended to be included within the scope of the appended claims.

I claim:

1. In a sewing machine having stitch forming instrumentalities including a reciprocating thread carrying needle and a loop-taker located in the bed of said sewing machine for grasping and expanding a loop of needle thread forming a work limb and a take-up limb as said needle penetrates the material being sewn, means associated with said looptaker for constraining said work limb and said take-up limb in different paths as said looptaker expands said loop of needle thread, an anti-haloing device comprising a throat plate having a bottom surface and a needle aperture formed therein through which said needle traverses, a fin-shaped member having smooth substantially unbroken surfaces depending from said throat plate in close proximity of said needle aperture and positioned in advance of said needle aperture in the direction of material feed, said fin-shaped member being arranged to occupy a position between said different paths in which said work limb and take-up limb of said loop of needle thread are constrained, said loop of needle thread being drawn across said fin member by the rotation of said looptaker during the stitch formation process thereby separating said work limb from said take-up limb and preventing said work limb from being prematurely drawn through the material being sewn due to frictional interengagement with said take-up limb.

2. An anti-haloing device as set forth in claim 1 wherein said a fin shaped member depends from the throat plate in the direction of material feed, said fin member being in close proximity of said needle aperture in such a position as when said loop taker grasps and expands a loop of thread said work limb is restrained on a side of said fin member, and when said loop taker has cast off said loop of thread, said take-up limb lies on a side of said fin member opposite said work limb, said work limb remaining separated from said take-up limb as said take-up limb is drawn through said needle aperture.

3. An anti-haloing device as set forth in claim 2 wherein said fin member has an inclined ramp surface, said inclined ramp surface increasing in height from a first extremity at the bottom surface of said throat plate toward a second extremity at said needle aperture.

4. In a sewing machine having a bed, a reciprocatory thread carrying needle and a vertical axis loop taker rotatably supported within said bed on a vertical shaft, said vertical shaft being located in front of said thread carrying needle in the direction of material feed, a bobbin case accommodated in said loop taker, said loop taker having a beak movable in a horizontal path about said bobbin case for grasping and expanding a loop of needle thread forming a work limb which is directed over the bobbin case and a take-up limb which is directed beneath the bobbin case as said needle rises through the material being sewn, an anti-haloing device comprising a throat plate horizontally arranged above the path of the loop taker beak and having an aperture formed therein through which said needle traverses, a fin-shaped member having smooth substantially unbroken surfaces depending from said throat plate along the direction of material feed for separating the work limb from the take-up limb of said loop of thread, said loop of needle thread being drawn across said fin member during the stitch formation process thereby preventing said work limb from being prematurely drawn through the material being sewn due to friction with said take-up limb.

* * * * *